US008479314B2

(12) United States Patent
Colanto et al.

(10) Patent No.: US 8,479,314 B2
(45) Date of Patent: Jul. 9, 2013

(54) BALLISTIC AND BLUNT IMPACT PROTECTIVE KNEE AND ELBOW PADS

(75) Inventors: David Colanto, Ashland, MA (US); Nicholas Tsantinis, Auburn, MA (US); Philip M. Cunniff, Shrewsbury, MA (US); Jason Christopher Parker, Graftou, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/288,991

(22) Filed: Nov. 4, 2011

(65) Prior Publication Data

US 2013/0111641 A1 May 9, 2013

(51) Int. Cl.
*A41D 13/00* (2006.01)

(52) U.S. Cl.
USPC ..... 2/24

(58) Field of Classification Search
USPC ..... 2/455, 16, 24, 267, 465, 2.5, 247, 2/22; 128/878, 881, 882; 602/23, 26, 62
See application file for complete search history.

(56) References Cited

U.S. PATENT DOCUMENTS

| | | | | |
|---|---|---|---|---|
| 2,266,886 | A * | 12/1941 | McCoy | 2/22 |
| 5,881,395 | A * | 3/1999 | Donzis | 2/455 |
| 5,943,694 | A | 8/1999 | Moureaux et al. | |
| 6,032,300 | A * | 3/2000 | Bainbridge et al. | 2/456 |
| 6,253,376 | B1 | 7/2001 | Ritter | |
| 6,347,413 | B1 * | 2/2002 | Sciscente et al. | 2/465 |
| 7,490,360 | B2 | 2/2009 | Meadows | |
| 7,661,148 | B2 * | 2/2010 | Landi et al. | 2/24 |
| 7,837,640 | B2 | 11/2010 | Greenwald et al. | |
| 7,900,271 | B2 | 3/2011 | Sonner | |

OTHER PUBLICATIONS

J Orthop Trauma, vol. 21, No. 4, Apr. 2007, "Characterization of Extremity wounds in Operation Iraqi Freedom and Operation Enduring Freedom"; Owens, Brett D., Kragh, Jr. John F., Macaitis, BS, Svoboda, Steven J. and Wenke, Joseph C., pp. 254-257.

* cited by examiner

*Primary Examiner* — Tejash Patel
(74) *Attorney, Agent, or Firm* — Roger C. Phillips

(57) ABSTRACT

A light-weight protective pad for an elbow or a knee providing both ballistic and blunt impact protection is disclosed. The pad has a rigid light weight composite cup removably attached to the outer surface of an abrasion resistant cover fabric. The cover fabric contains a thermally formed armor cup providing ballistic protection and a foam layer to aid in absorption of blunt impacts. The inner surface of the pad is lined with felt.

14 Claims, 7 Drawing Sheets

BALLISTIC AND BLUNT IMPACT PROTECTIVE KNEE AND ELBOW PADS

BACKGROUND

1. Field

The aspects of the present disclosure relate generally to body armor and in particular to knee and elbow pads providing ballistic and blunt impact protection.

2. Description of Related Art

A recently completed study profiled combat related injuries to U.S. service members participating in Operation Iraqi Freedom (OIF) and Operation Enduring Freedom (OEF) from October 2001 through January 2005 and found that a majority of these injuries (54%) were to the extremities ("Characterization of Extremity Wounds in Operation Iraqi Freedom and Operation Enduring Freedom." J. Orthopedic Trauma 21 (4) 2007). Currently fielded knee and elbow pads attenuate blunt impact but are not designed to provide fragmentation protection.

A Small Business Innovation Research (SBIR) Topic entitled "Advanced Articulated Soldier Knee and Elbow Protection System" was solicited by the Department of Defense. The topic goal was to design and build a ballistic and blunt-trauma protective knee and elbow pad system that addressed retention, articulation, protection and weight. The pad designs were required to interface with the Army Combat Uniform (ACU) and not degrade maneuverability. Also, the pad system must protect against a 9 mm 124 grain full metal jacket (FMJ) bullet travelling at a speed of 1175 feet per second, as defined by National Institute of Justice (NIJ) Standard 0101.04, Type II. No specific criteria were listed to define the required blunt impact protection except a statement that the pads need to minimize damage from blunt impact. The topic set a relatively large weight limit of 2.0 lb (pound) and 1.5 lb per pad for the knee and elbow pads, respectively. These weight limits are more than three times the weight of current non-ballistic solutions and pads weighing that much will likely have a negative effect on maneuverability.

The integrated elbow and knee pad sub-system of the current Army Combat Uniform (ACU) will only protect against blunt force impacts and scrapes. Ballistic protection has been effectively integrated into the soldier helmet and Interceptor Body Armor but not into the knee and elbow pads. There is a need to mitigate injuries to Soldier extremities while dismounted, such as injuries to knees and elbows. Therefore, there is a need to integrate fragmentation protection with knee and elbow pads to protect the joints and reduce extremity casualties.

Accordingly, it would be desirable to provide knee and elbow pads that resolves at least some of the problems identified above.

SUMMARY

As described herein, the exemplary embodiments overcome one or more of the above or other disadvantages known in the art.

One aspect of the present disclosure relates to a protective pad for an elbow or a knee that provides both ballistic and blunt impact protection. The pad has a rigid cup removably attached to the outer side of a cover fabric. The cover fabric contains an armor cup and a foam layer and the inner surface of the pad is lined with felt.

Another aspect of the present disclosure relates to a method for fabricating a protective armor cup. The cup is formed by stretching a plurality of layers of armor fabric over a mold; placing the mold and the stretched layers of armor fabric inside a vacuum bag; pulling a vacuum in the bag such that pressure is applied to the stretched layers of armor fabric and the mold; applying pressure and heat to the vacuum bag, the contained layers of armor fabric and the mold, for a period of time; removing the thermally formed layers of armor fabric from the vacuum bag and mold; and affixing the layers of armor fabric to each other.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DETAILED DESCRIPTION OF THE DISCLOSED EMBODIMENTS

Figure 1:
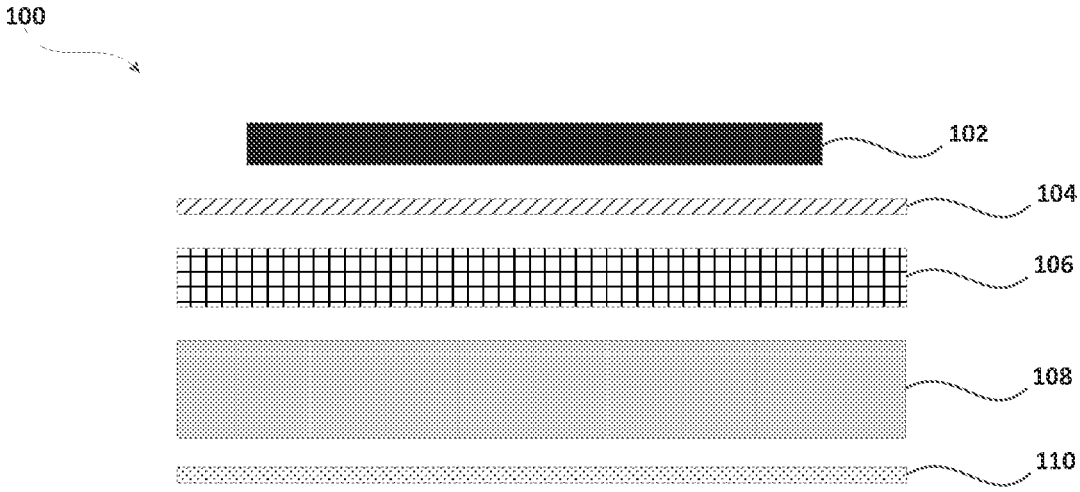
FIG. 1 illustrates an exemplary material layup used in one embodiment of the ballistic and blunt protective knee and elbow pads incorporating aspects of the present disclosure.

Referring now to the drawings, where like reference numerals are used to refer to like elements throughout, there can be seen in FIG. 1 a material layup used in an exemplary embodiment of the ballistic and blunt protective knee and elbow pads. The protective layers of the exemplary protective pad 100 comprise a rigid cup 102, armor cup 106, and a layer of foam 108 to help absorb blunt impacts. These protective layers are contained in an abrasion resistant cover material 104, and a felt backing 110 provides friction to help keep the pad in place. The outer most layer of the exemplary pad 100 shown comprises a rigid cup 102 made from a composite material such as for example carbon fiber and epoxy resin. Beneath the rigid cup 102 is a layer of cover fabric 104. The cover fabric 104 is durable and highly abrasion resistant and may be constructed of a material such as for example 500 denier nylon 6.6 fabric. Nylon 6.6 is known in the art and comprises long molecular chains made of hexamethylenediamine and adipic acid yielding nylon with a total of 12 carbon atoms giving the material its name. Suitable fabrics of this type are manufactured by Koch Industries Inc. under the Cordura® brand name. The cover fabric forms a cover layer that partially surrounds and holds the armor cup 106 and the foam layer 108 together and forms a base for attaching straps and other items to the pad. The rigid cup 102 is attached to the outer surface of the cover fabric 104 by several painted brass snaps. Beneath the cover fabric 104 is an armor cup 106 made from multiple plies of armor fabric shaped into a cup that conforms to the shape of the wearer. Blunt impact absorption is enhanced by including a 0.5 inch layer of foam 108 beneath the armor cup 106. The inside of the pad is lined with a layer of black felt 110 that provides friction between the pad and the wearer's ACU to help keep the pad in place while it is being worn.

The exemplary pad 100 of the exemplary embodiment illustrated in FIG. 1 adds fragmentation protection with a minimum weight penalty. The rigid cup 102 is constructed of a strong and lightweight material which provides weight savings. Reducing the weight of the rigid cup 102, allows additional armor fabric to be added to the armor cup 106 while maintaining a desirable pad weight. In one embodiment, the weight per pad of the knee and elbow pads is approximately 200 grams (g) for the knee pads and 100 g for the elbow pads.

Figure 2:
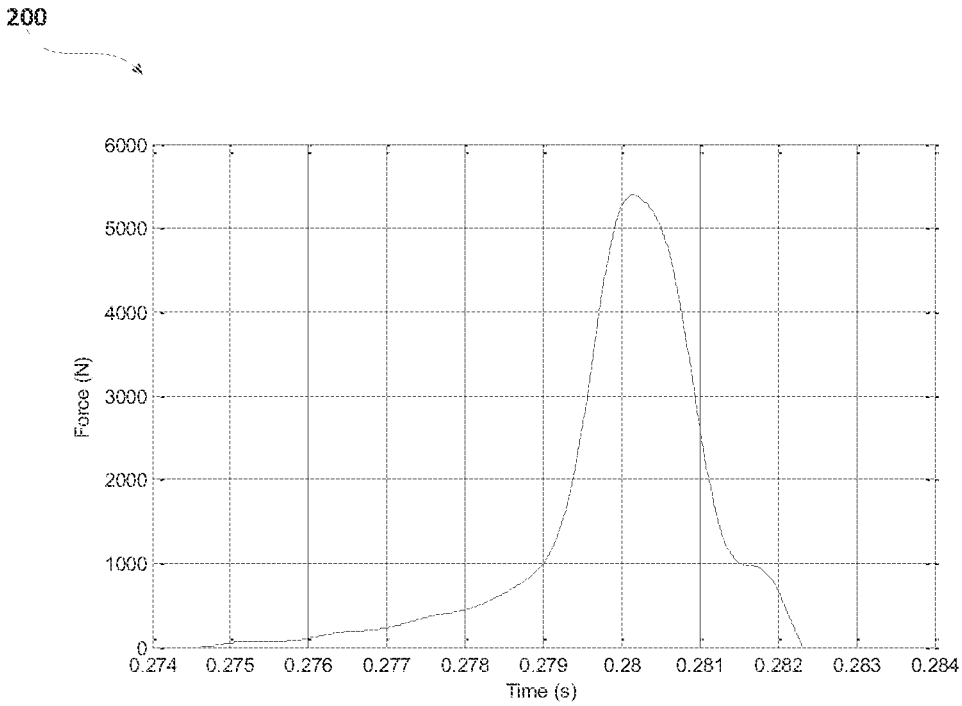
FIG. 2 shows a graph of force transducer data versus time collected from the first drop test on a prior art knee pad.

Blunt impact protection is enhanced using a layer of foam 108 behind the armor cup 106. A guided mono-rail drop tower was used to evaluate various types of foam with a 2.5 kg (kilogram) striker impacting each test sample at 9 ft/s (feet per second). The test sample was positioned on top of a polished steel impact anvil designed according to the Motorcycle Protective Equipment Standard EN 1621-1. An accelerometer was positioned on top of the striker and a piezoelectric force transducer was placed between the anvil and the massive base of the equipment. FIG. 2 shows a graph 200 of force transducer data versus time collected from the first drop test on a prior art knee pad. The average peak force value for two drops on the prior art pad was 5400 N (newton).

A series of tests was performed on different types foam layers. The types of foam tested include Ethylene-Vinyl Acetate (EVA), a proprietary foam, and neoprene foam. The EVA and neoprene foams were also tested at different thicknesses. Closed-cell EVA foams are typically used in blunt-impact mitigation applications so additional thicknesses of EVA foam were tested. These foams were placed inside an exemplary prototype knee pad and impacted as described above. The exemplary prototype pad consisted of an eight layer carbon fiber cup, 30 plies of 180 denier spectra 2000 fabric and the test foam held inside a 500 denier nylon 6.6 outer cover material. Table 1 summarizes the average peak force for the different foams tested as well as their respective thickness and areal densities. The average peak force value provided for each type of foam was calculated using results from three separate drops.

TABLE 1

Drop test results of exemplary knee pad with various foam layers.

| MATERIAL | THICKNESS (in) | AREAL DENSITY ($Lb/ft^2$) | AVG. PEAK FORCE (N) |
|---|---|---|---|
| NO FOAM | N/A | N/A | 5510 |
| EVA | 0.13 | 0.02 | 5420 |
| EVA | 0.25 | 0.04 | 5430 |
| EVA | 0.38 | 0.06 | 5390 |
| EVA | 0.50 | 0.08 | 4420 |
| NEOPRENE | 0.16 | 0.24 | 5440 |
| NEOPRENE | 0.24 | 0.26 | 5430 |
| PROPRIETARY | 0.75 | 0.81 | 2139 |

Figure 3:
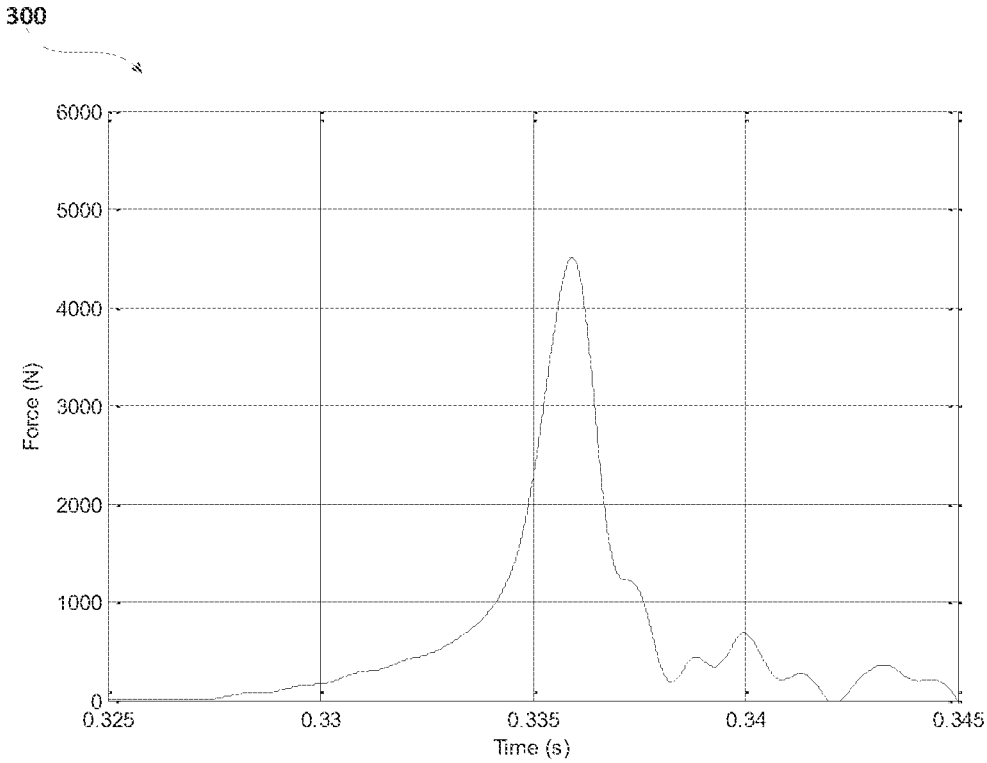
FIG. 3 shows a graph of force transducer data versus time for an exemplary pad with a half inch thick layer of EVA foam which incorporates aspects of the present disclosure.
Figure 4:
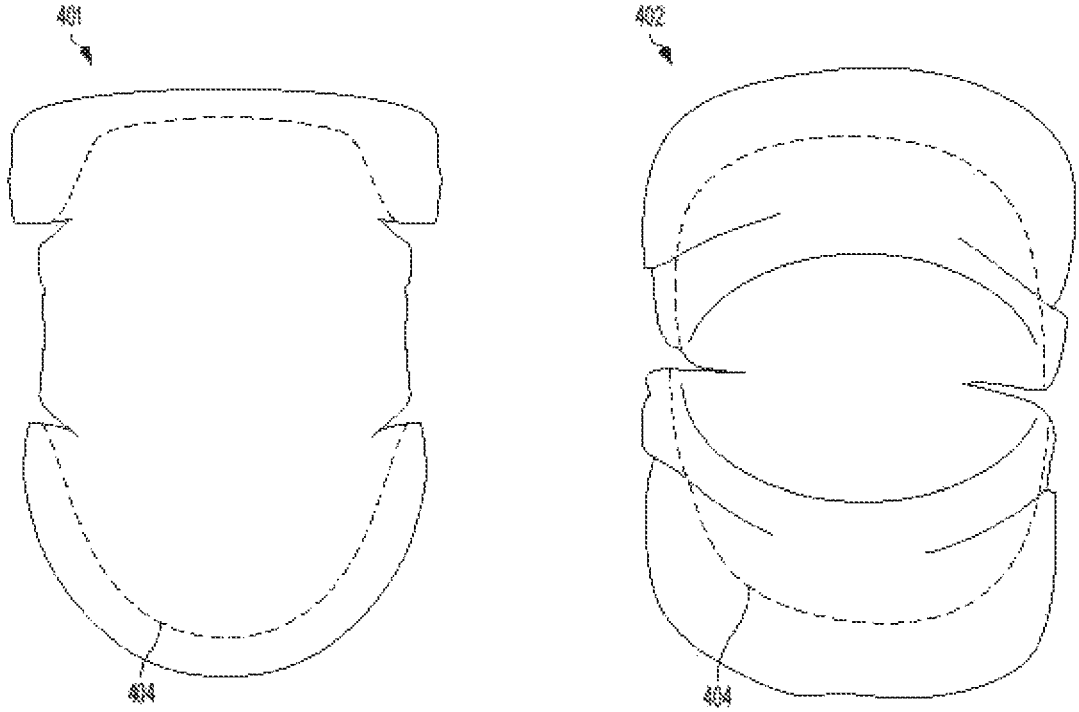
FIG. 4 illustrates an exemplary embodiment of shaped foam layers used in the knee and elbow pads incorporating aspects of the present disclosure.

These tests results suggest that the layers of armor fabric used in the armor cup 106 were assisting with blunt-impact mitigation as can be seen in the graph 300 shown in FIG. 3 which illustrates force transducer data versus time for the exemplary prototype pad with a half inch thick layer of EVA foam. Performance of the prior art knee pad was slightly surpassed by the half inch thick EVA foam. The Neoprene foam had similar results compared to EVA of equivalent thickness, but is approximately six times heavier. The proprietary foam exhibited excellent blunt-impact performance, but at three-quarters inch was substantially thicker and roughly ten times heavier than the half inch thick EVA foam. In an exemplary embodiment, the EVA foam is half an inch thick. FIG. 4 illustrates an exemplary embodiment of the shaped foam layers used in the knee 401 and elbow 402 pads. The foam is cut to the shape of the knee 401 and elbow 402 pads with triangular sections removed to allow for easier joint motion. Stitching 404 is also used to properly shape the layer of foam.

For the rigid cup 102 material, the exemplary embodiment utilizes carbon fiber which is lightweight and extremely durable. Two types of fabric are used in the exemplary embodiment: a woven fabric, and a unidirectional (UD) tape. Both the woven and unidirectional fabrics are available as pre-preg. Pre-preg is a term used to describe composite materials that are pre-impregnated with a sufficient amount of matrix material, such as for example polyepoxide resin, to bond the fibers together and to bond them to other layers. In the exemplary embodiment shown in FIG. 1 the matrix material is a thermoset polyepoxide resin, commonly referred to as epoxy. The carbon fiber pre-preg used in one exemplary embodiment is produced by JD Lincoln Inc. under the designation L-929. The outer layers comprise woven fabric while the inner layers comprise unidirectional tape with the fibers of each layer oriented at different angles. The rigid cup 102 is layered with 8 total layers as follows:

Layer 1: woven fabric.

Layers 2-7: UD tape oriented at: 0° (degrees), −90°, 45°, −45°, 90°, 0°.

Layer 8: woven fabric.

Figure 5:
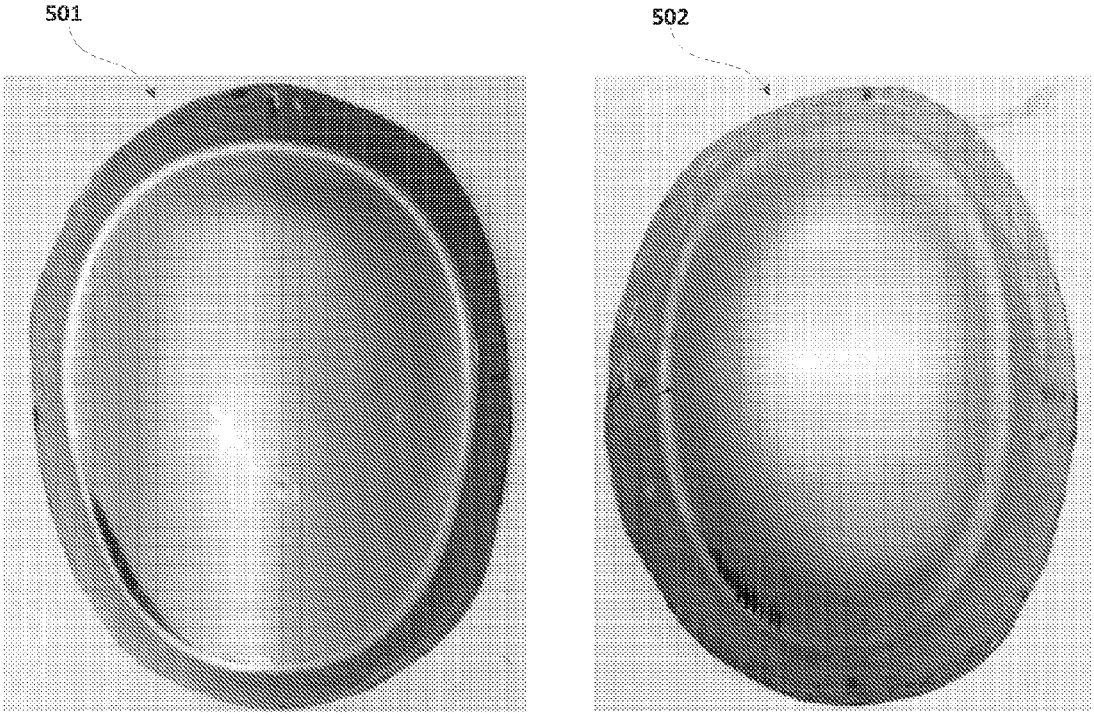
FIG. 5 illustrates aluminum-filled epoxy tools for molding protective cups incorporating aspects of the present disclosure.

The 8 layers of carbon fiber pre-preg are placed onto a custom made epoxy mold. The knee cup mold 501 and elbow cup mold 502 are shown in FIG. 5.

The entire mold, such as knee cup mold 501 or elbow cup mold 502, along with the 8 layers of carbon fiber pre-preg fabric arranged on it, is then placed into a vacuum bag where a vacuum is pulled to apply pressure to the parts. The vacuum bag with the molds and fabric in place is then placed into an autoclave and allowed to cure at approximately 250° F. for about 2 hours at 50 psi (pounds per square inch). After the autoclave cycle is completed, the rigid knee and elbow pad cups are removed from the vacuum bag and removed from their respective knee 501 and elbow 502 molds. The edges of each cup 102 are then cut to shape and several 0.3 in diameter holes are drilled into each cup 102. The holes are used for attaching the cup 102 to the outer fabric 104. Black painted, brass snaps are press-fit through the holes to attach the cup to the cover fabric 104. The final weights of the exemplary carbon fiber knee and elbow cups were approximately 37 g (grams) and 18 g, respectively. With the weight savings of the new rigid cup design, the exemplary pads allowed the total weight of the armor cup to be approximately 68 g for the knee pad and approximately 25 g for the elbow pad. An exemplary weight budget for the knee and elbow pads is shown in Table 2 below. It will be appreciated that target weights and weight budgets shown are exemplary only and that other target weights and different weight budgets resulting in different amounts of armor fabric, cup types, and foam, may be chosen without straying from the spirit and scope of the disclosure.

TABLE 2

Knee and elbow bad weights

| | cup | outer fabric | foam | straps, buckles, velcro | fabric armor | entire pad |
|---|---|---|---|---|---|---|
| Natick knee | 37 | 21 | 29 | 37 | 68 | 200 |
| Natick elbow | 18 | 18 | 23 | 16 | 25 | 100 |

The armor material used in the exemplary embodiment shown in FIG. 1 is made from ultra-high molecular weight polyethylene (UHMWPE) that is gel spun into fibers and woven into a fabric. In one embodiment 180 denier Spectra 2000 woven fabric was used. With this fabric the exemplary weight budget shown in Table 2 allowed for 30 plies of armor fabric to be used in the armor cup 106. Alternatively an equivalent areal density of an aramid fabric may be used such as for example 14 layers of 600 denier fabric constructed with organic fibers from the aromatic polyamide family. One such suitable material is available under the Kevlar® brand name as style 706 KM2. Para-aramid synthetic fiber materials such as for example Kevlar® are more widely available than UHMWPE and provide for a lower cost alternative. The fabric layers of the exemplary armor cup are placed onto the molds 501, 502 of the knee and elbow cup and each individual layer is pulled tightly over the mold so the fabric to completely takes the shape of the mold. Once all the layers of fabric are fit onto the mold, the assembly is placed into a vacuum bag, and a vacuum is then pulled to hold the fabric in place on the molds. The bag and the mold assemblies it contains are then placed into an autoclave and allowed to heat to approximately 250° Fahrenheit for about 2 hours at 50 psi. After the autoclave cycle is complete each thermally formed armor cup is removed from the vacuum bag and molds. The thermally formed armor fabric retains the shape of the knee and elbow cup molds forming armor cups. The layers of armor fabric forming each armor cup are then affixed to each other such as for example by being sewn together and are trimmed to size, thereby forming the exemplary thermally formed armor cup 106. Typical methods of shaping fabrics use cutting and darting when forming complex curvatures. Darting is a sewing technique that helps fit fabric to a curve. There are many types of darts but a typical dart uses two stitch lines to bring together a fold of fabric. The process described here for thermally forming the armor cup allows for shaping fabrics with complex curvatures without the need for cutting or darting.

Figure 6:
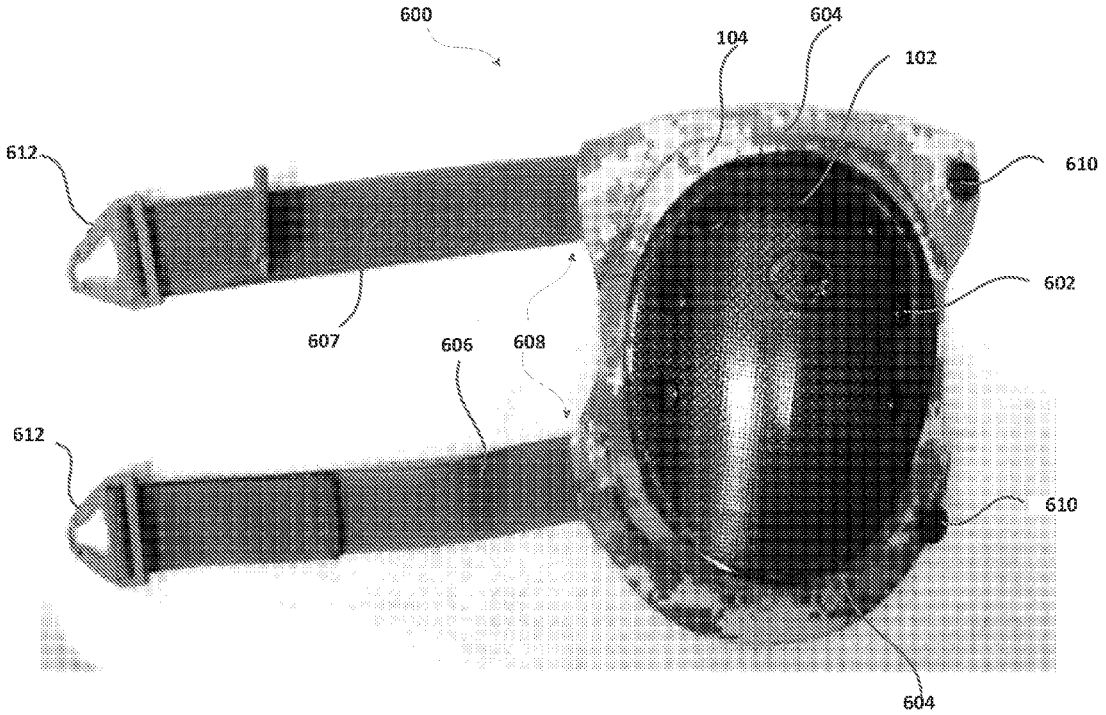
FIG. 6 illustrates an assembled exemplary knee pad incorporating aspects of the present disclosure.

Referring now to FIG. 6, a front view of a fully assembled exemplary knee pad 600 is illustrated. The carbon fiber cup 102 is removably attached to the abrasion resistant cover material 104 using six painted brass snaps 602. The armor cup 106 and foam layer 108 are held in place within the cover material 104 by an attachment means such as for example stitching 604. The knee pad 600 is held on the wearer's knee by two knee pad retention straps 606, 607. A first end 608 of each strap 606, 607 is fixedly attached to the pad as shown by attachment means such as for example sewing. The other end of each strap 606, 607 is adjustably attached using buttons 610, preferably metal MIL-SPEC buttons, and buckles 612, preferably commercially available plastic buckles. The buckles are adjustably attached to the straps 606, 607 and are configured to engage the buttons 610. The upper pad retention strap 607 is preferably constructed of an elastic material, such as for example nylon, and the lower strap 606 is preferably a standard non-elastic material, such as for example nylon. This arrangement of elastic and non-elastic straps provides for superior retention of the pads during use.

Figure 7:
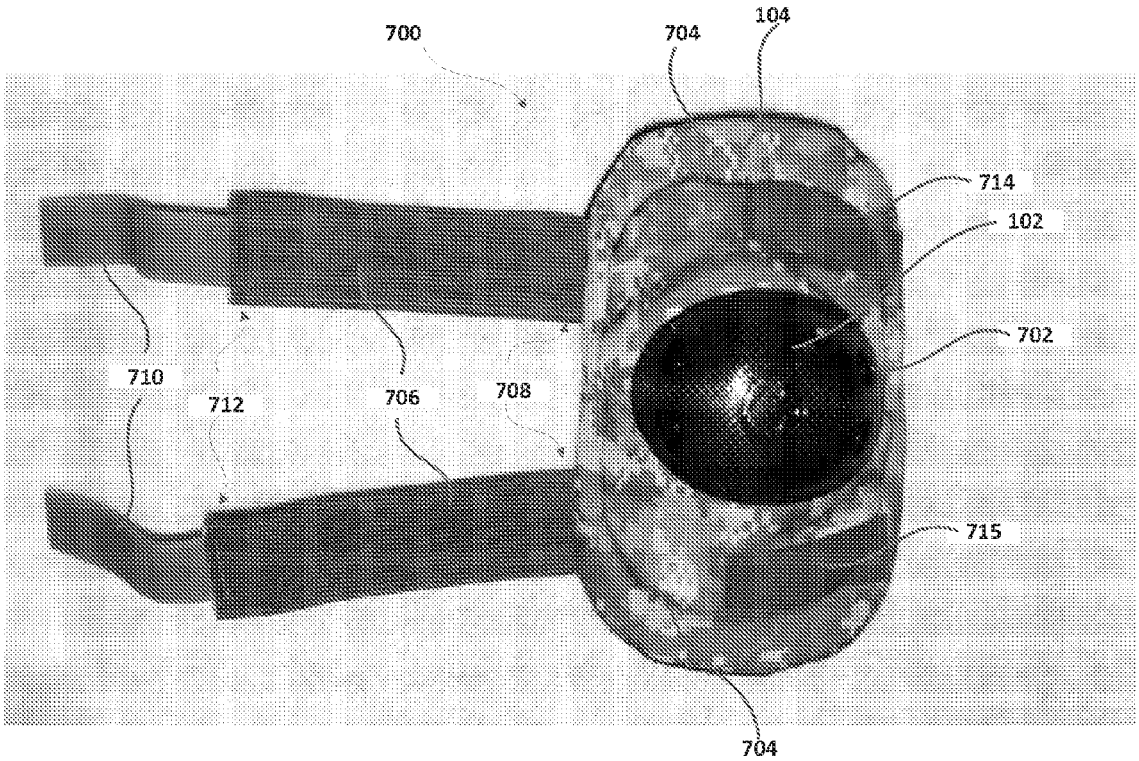
FIG. 7 illustrates an assembled exemplary elbow pad incorporating aspects of the present disclosure.

FIG. 7 illustrates an exemplary fully assembled elbow pad 700. A rigid cup 102 is removably attached to an abrasion resistant cover material 104 with four painted brass snaps 602. The armor cup and foam layer are held in place within the cover material 104 by an attachment means such as stitching 704. The elbow is held on the wearer's elbow while being worn by two elbow pad retention straps 706. Both retention straps 706 may be constructed from an elastic material, such as for example nylon material and have one end 708 fixedly attached to the elbow pad 700. The other end of each strap 706 may be attached to the elbow pad 700 using a hook and loop fastener such as those sold under the Velcro® brand name. A length of the hook portion 710 of the hook-and-loop fastener is attached to the loose end 712 of each elastic strap 706. Alternatively, the hook portion of the fastener may be attached to the face of each strap 706 such that it does not extend beyond the end of the strap 706. The loop portion of the fastener 714, 715 is attached to the face of the pads such that the loose end 710 of each strap may be adjustably attached to the face of the pad at 714 and 715 to hold the pad in place during use. The exemplary embodiment of the knee and elbow pads shown in FIGS. 6 and 7 uses stitching to assemble many of the parts, however it will be appreciated through practice of this disclosure that other means of assembly, such as for example adhesives and rivets, may be used without straying from the spirit and scope of the disclosure.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit and scope of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A protective pad for an elbow or a knee comprising:

a rigid cup attached to the outer side of a cover fabric;

an armor cup and a foam layer contained by the cover fabric; and a layer of felt lining an inner side of the pad.

2. The pad of claim 1 wherein the rigid cup comprises one or more layers of a composite of carbon fibers bonded with a polyepoxide matrix material.

3. The pad of claim 2 wherein the one or more layers comprise:

an outer layer of woven carbon fiber fabric;

a unidirectional carbon fiber tape layer oriented at zero degrees;

a unidirectional carbon fiber tape layer oriented at ninety degrees;

a unidirectional carbon fiber tape layer oriented at forty-five degrees;

a unidirectional carbon fiber tape layer oriented at minus forty-five degrees;

a unidirectional carbon fiber tape layer oriented at minus ninety degrees;

a unidirectional carbon fiber tape layer oriented at one-hundred-eighty degrees; and an inner layer of woven carbon fiber fabric.

4. The pad of claim 2 wherein the rigid cup is attached using snaps.

5. The pad of claim 1 wherein the armor cup comprises multiple plies of a thermally formed armor fabric.

6. The pad of claim 4 wherein the armor fabric comprises synthetic fibers selected from the group comprising gel spun ultra-high molecular weight polyethylene and aramid fibers.

7. The pad of claim 1 wherein the foam layer comprises a material selected from the group comprising ethylene-vinyl-acetate and neoprene.

8. The pad of claim 1 wherein the cover fabric comprises fibers made from nylon 6.6.

9. The pad of claim 1 further comprising an attachment means for attaching the pad to wearer, the attachment means comprising an upper strap and a lower strap, the upper strap comprising an elastic material and the lower strap comprising a non-elastic material, wherein one end of each strap is fixedly attached to a first side of the pad and the second end is removably attached to a second side of the pad, and wherein the length of each strap is adjustable.

10. A method for fabricating an armor cup comprising:

stretching a plurality of layers of armor fabric over a mold;

placing the mold and the stretched layers of armor fabric inside a vacuum bag;

pulling a vacuum in the bag such that pressure is applied to the layers of armor fabric and the mold;

applying pressure and heat to the vacuum bag, the contained layers of armor fabric and the mold, for a period of time;

removing the thermally formed layers of armor fabric from the vacuum bag and mold; and affixing the layers of armor fabric to each other.

11. The method of claim 10 wherein the armor fabric comprises fibers selected from the group comprising gel spun ultra-high molecular weight polyethylene and aramid synthetic fibers.

12. The method of claim 10 wherein applying heat further comprises placing the vacuum bag, the contained layers of armor fabric and the mold into an autoclave at a temperature of about two-hundred-fifty degrees Fahrenheit (250° F.) or greater.

13. The method of claim 10 wherein applying pressure further comprises placing the vacuum bag, the contained layers of armor fabric and the mold into an autoclave with a pressure of about fifty pounds per square inch (50 psi) or greater.

14. The method of claim 10 wherein the affixing comprises sewing the layers of armor fabric together.

* * * * *